US007859485B2

(12) United States Patent
Oh

(10) Patent No.: US 7,859,485 B2
(45) Date of Patent: Dec. 28, 2010

(54) PLASMA DISPLAY PANEL

(75) Inventor: Jae Young Oh, Taegu-si (KR)

(73) Assignee: LG Electronics Inc., Seoul (KR)

( * ) Notice: Subject to any disclaimer, the term of this patent is extended or adjusted under 35 U.S.C. 154(b) by 1387 days.

(21) Appl. No.: 11/330,389

(22) Filed: Jan. 12, 2006

(65) Prior Publication Data

US 2006/0152132 A1 Jul. 13, 2006

(30) Foreign Application Priority Data

Jan. 13, 2005 (KR) ..... 10-2005-0003472

(51) Int. Cl.
*G09G 3/28* (2006.01)
*G09G 3/10* (2006.01)

(52) U.S. Cl. ..... 345/60; 315/169.4

(58) Field of Classification Search ..... 345/60–67, 345/37; 315/169.4
See application file for complete search history.

(56) References Cited

U.S. PATENT DOCUMENTS

| | | | | |
|---|---|---|---|---|
| 5,754,329 | A * | 5/1998 | Coleman | 359/254 |
| 6,097,365 | A * | 8/2000 | Makino | 345/99 |
| 6,169,363 | B1 * | 1/2001 | Mori et al. | 313/582 |
| 6,831,405 | B2 * | 12/2004 | Kim et al. | 313/504 |
| 2001/0024179 | A1 * | 9/2001 | Nakamura | 345/60 |
| 2002/0000961 | A1 * | 1/2002 | Kang | 345/87 |
| 2002/0180354 | A1 * | 12/2002 | Sano et al. | 313/582 |
| 2003/0168977 | A1 * | 9/2003 | Hashikawa | 313/582 |
| 2004/0257306 | A1 * | 12/2004 | Choi | 345/60 |

FOREIGN PATENT DOCUMENTS

| | | | |
|---|---|---|---|
| EP | 0 853 306 | A1 | 7/1998 |
| EP | 853306 | A1 * | 7/1998 |
| EP | 0 938 073 | A2 | 8/1999 |
| EP | 938073 | A2 * | 8/1999 |
| EP | 1 437 703 | A1 | 7/2004 |
| EP | 1437703 | A1 * | 7/2004 |
| KR | 10-2004-0000578 | A | 1/2004 |
| KR | 1020040000578 | A * | 1/2004 |

OTHER PUBLICATIONS

Korean Office Action dated Sep. 27, 2006.
European Search Report dated Jul. 28, 2006.

* cited by examiner

*Primary Examiner*—Amr Awad
*Assistant Examiner*—Liliana Cerullo
(74) *Attorney, Agent, or Firm*—KED & Associates, LLP

(57) ABSTRACT

The present invention relates to a plasma display panel. The plasma display panel of the present invention is divided into three or more regions. Address electrodes located in each region are classified into electrode groups. Each of the electrode groups is supplied with a driving signal from an additional data driver. Therefore, high speed driving is made possible during the address period and voltage drop in the electrodes can be compensated. Furthermore, since a discharge period can be relatively extended, the display quality can be improved.

8 Claims, 11 Drawing Sheets

PLASMA DISPLAY PANEL

BACKGROUND OF THE INVENTION

1. Field of the Invention

The present invention relates to a plasma display panel, and more particularly, to a plasma display panel that can operate at high speed and can supply a uniform driving signal voltage.

2. Discussion of Related Art

A plasma display panel includes a discharge cell formed between a rear substrate in which barrier ribs are formed and a front substrate opposite to the rear substrate. In the plasma display panel, vacuum ultraviolet rays generated when an inert gas within each discharge cell is discharged with a high frequency voltage excite phosphors, thus implementing images.

FIG. 1 is a view illustrating the arrangement of electrodes of a general plasma display panel. The related art will be described with reference to FIG. 1.

Referring to In FIG. 1, scan electrode lines Y1 to Yn and sustain electrode lines Z1 to Zn are parallel to each other. Address electrode lines X1 to Xn (data electrode lines) cross the scan/sustain electrode lines. Each of discharge cells 1 is formed at a point where the electrodes cross one another.

A scan pulse is supplied through the scan electrode lines Y1 to Yn during the address period, so that the discharge cells 1 are scanned on a line basis. During the sustain period, a sustain pulse is supplied, so that a discharge is sustained in the discharge cells 1.

The sustain pulse is commonly supplied through the sustain electrode lines Z1 to Zn during the sustain period. Therefore, a discharge is sustained in the discharge cell 1 along with the scan electrode lines Y1 to Yn.

Furthermore, a data pulse is supplied on a line basis in synchronization with the scan pulse through the address electrode lines X1 to Xn during the address period. Therefore, the discharge cell 1 in which a discharge will be sustained is selected.

The scan/sustain/address electrode lines Y/Z/X are connected to drivers that supply the driving pulses. The drivers are generally formed on a printed circuit board (not shown) disposed on a rear surface of the plasma display panel. The drivers are connected to a pad unit of the electrodes formed at one side of the plasma display panel by means of a Flexible Print Cable (FPC), a Flat Flexible Cable (FFC) or the like.

FIG. 2 is a view illustrating a scan method of the plasma display panel. FIG. 2*a* is a view illustrating a single scan method and FIG. 2*b* is a view illustrating a dual scan method.

In the single scan method as shown in FIG. 2*a*, while an electrode line is selected by sequentially applying the scan pulse to lines from the first line to the last line of the scan electrode, one of the discharge cells 1 of the selected line, which will be discharged, is selected by applying the data pulse to the address electrode in synchronization with the scan pulse.

That is, assuming that scanning begins from the top right end of the plasma display panel 7, the scan driver 3 sequentially supplies the scan pulse beginning from the first scan electrode line Y1 and the data driver 2 supplies the data pulse, so that data are supplied to the discharge cell of a first discharge cell line 6.

Thereafter, data are supplied to the discharge cell on a second discharge cell line by means of the data pulse supplied to the address electrode lines X1 to Xn and the scan pulse supplied to the second scan electrode line Y2.

In the same manner, during the address period, lines from the first discharge cell line to an $N^{th}$ discharge cell line are sequentially selected and data are then supplied to the selected lines.

On the other hand, the dual scan method is a method of performing scanning by bisecting a central portion of the plasma display panel as shown in FIG. 2*b*. Scan lines from a first scan line Y1 to a $(n/2)^{th}$ scan line (Yn/2) are supplied with data pulses in synchronization with scan pulses that are sequentially supplied from a first data driver 4. Scan lines from a $((n+1)/2)^{th}$ scan line Y(n/2+1) to a $n^{th}$ scan line Yn are supplied with signals in synchronization with scan pulses that are sequentially supplied from a second data driver 5.

That is, in the dual scan method, the first half part and the second half part of the plasma display panel are scanned at the same time by means of a scan driver 3 during the address period. Therefore, the address period can be reduced approximately by half in comparison with the single scan method of the same resolution. Therefore, the dual scan method is advantageous in that the sustain period can be relatively extended and the display quality can be improved.

Meanwhile, the electrode lines X, Y and Z formed in the plasma display panel 7 has a high resistance value. Therefore, when a large-scale screen panel is driven, a relatively low voltage driving signal is applied to a discharge cell close to each of the drivers 2 to 5 due to voltage drop, and a relatively high voltage driving signal is applied to a discharge cell, which is far away from each of the drivers 2 to 5. Therefore, a relatively low voltage driving signal is supplied to the driver 2 and a discharge cell due to voltage drop.

That is, in the related art single scan method, a uniform driving signal (driving voltage) cannot be supplied to the entire discharge cells within the plasma display panel. As a result, a problem arises because the picture quality becomes uneven every panel region.

To solve this problem, the dual scan method has been used as shown in FIG. 2*b*. However, as a large-scale screen panel of 50 inch or more emerges, the problem in the single scan method remains intact. Furthermore, in the dual scan method, although the data drivers 4, 5 are respectively disposed at the top and bottom of the plasma display panel 7, voltage drop is generated at the center, which is far away from each driver, if the size of the plasma display panel becomes great. This results in variations in a driving signal.

SUMMARY OF THE INVENTION

Accordingly, the present invention has been made in view of the above problems, and it is an object of the present invention to provide a plasma display panel in which an address electrode is driven with it being divided into three or more electrode groups so that high-speed scanning is possible during an address period where data pulses and scan pulses are supplied.

A plasma display panel according to the present invention includes one or more scan electrodes and a sustain electrode formed in a front substrate, one or more address electrodes formed in a rear substrate opposite to the front substrate, the address electrodes crossing the scan electrodes and the sustain electrode, and barrier ribs formed between the front substrate and the rear substrate, for partitioning a discharge space. The address electrodes are driven with them being divided into three or more electrode groups.

The address electrodes are divided into three regions between upper and lower sides of a display region of the plasma display panel and are classified into first to third electrode groups belonging to each region. The address electrodes are connected to first to third data drivers that apply driving signals to the first to third electrode groups, respectively.

Signal lines of each of the first to third electrode groups are connected to each of the first to third data drivers through a pad unit. More particularly, the signal lines of the second electrode group are connected to the pad unit through the contact electrodes.

The contact electrodes are formed on the rear substrate below the first and third electrode groups. An insulation layer is formed to cover the contact electrodes, and is insulated from the first and third the electrodes.

In this case, the first to third electrode groups are supplied with the driving signals at the same time. Therefore, a time taken to scan the address electrodes can be shortened. In the same manner, the address electrodes can be driven with them being divided into four or more electrode groups.

DETAILED DESCRIPTION OF PREFERRED EMBODIMENTS

A plasma display panel in which driving signals are applied by three or more data drivers according to an embodiment of the present invention will now be described with reference to the accompanying drawings.

In the present specification, an embodiment of the plasma display panel according to the present invention is not limited to the following embodiment, but may be plural in number.

An embodiment of the present invention will be described in detail with reference to FIGS. 3 to 8.

Figure 1:
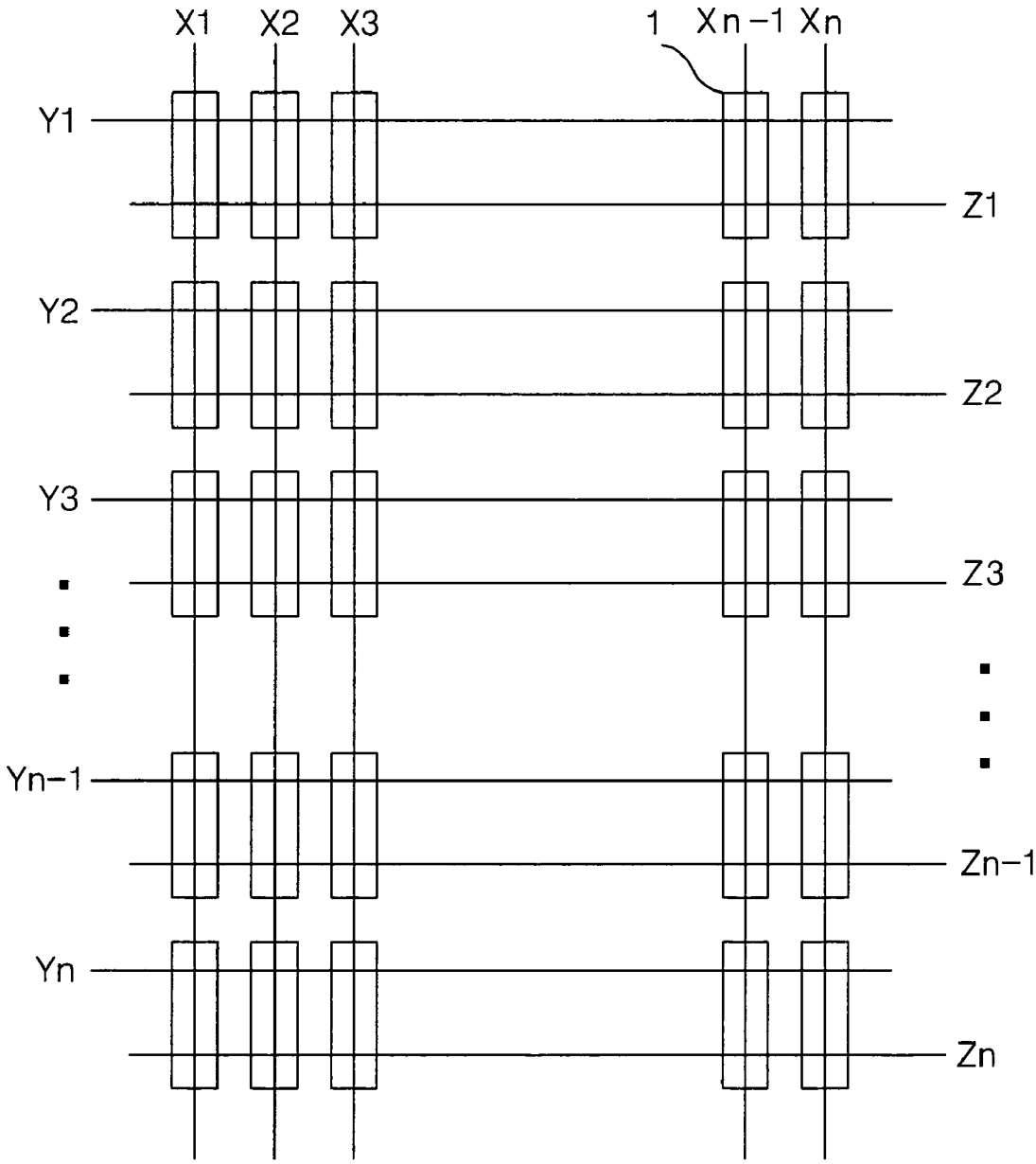
Fig.1 (related art)
FIG. 1 is a view illustrating the arrangement of electrodes of a general plasma display panel.
Figure 2A:
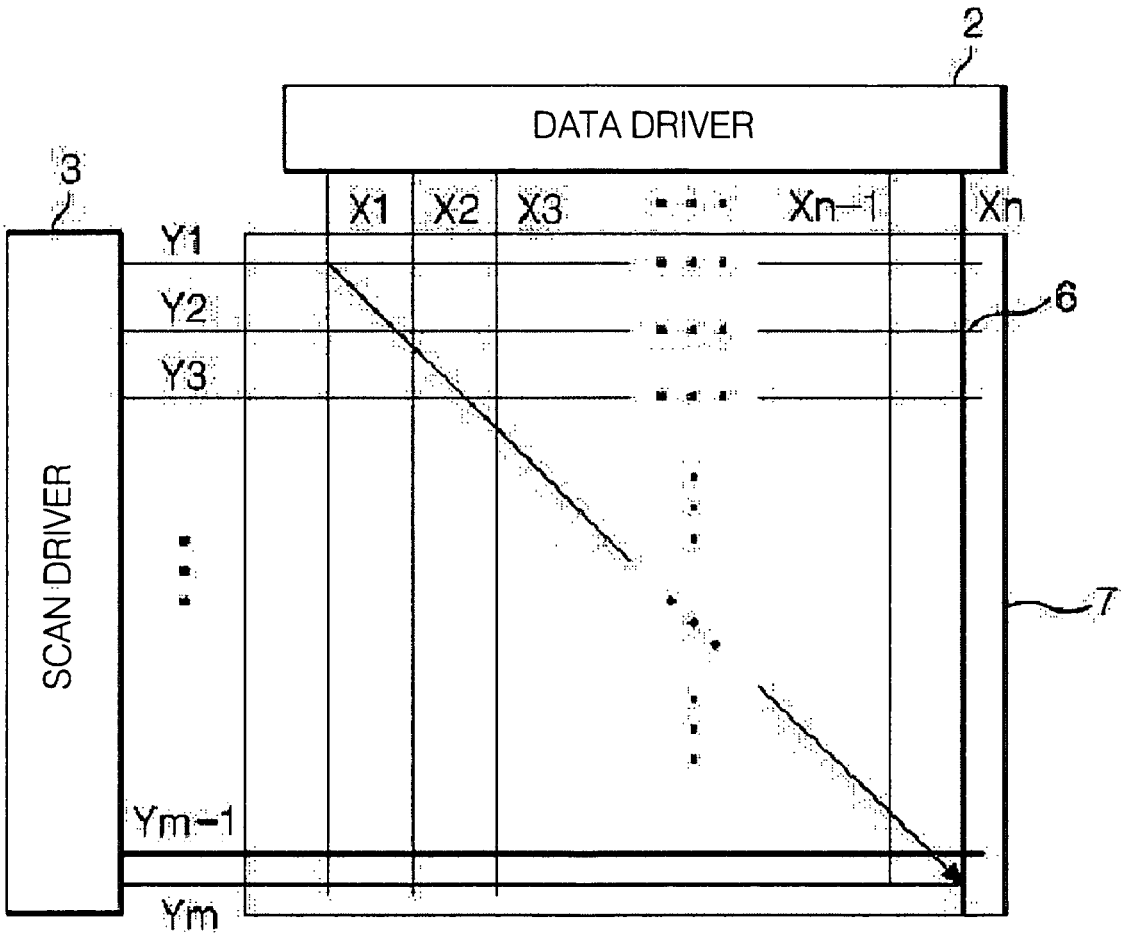
Fig.2a (related art)
FIG. 2 is a view illustrating a method of driving the plasma display panel.
Figure 2B:
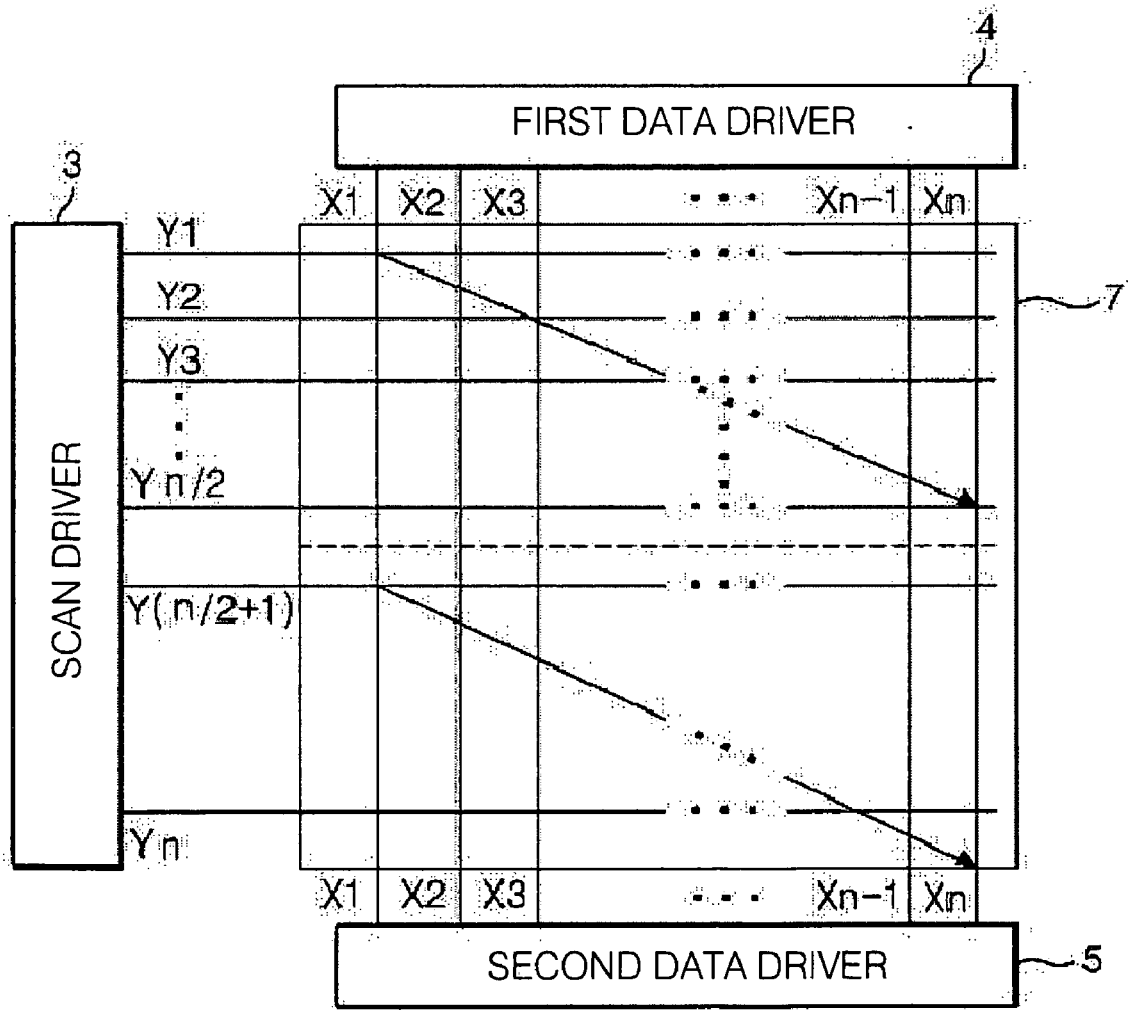
Fig.2b (related art)
Figure 3:
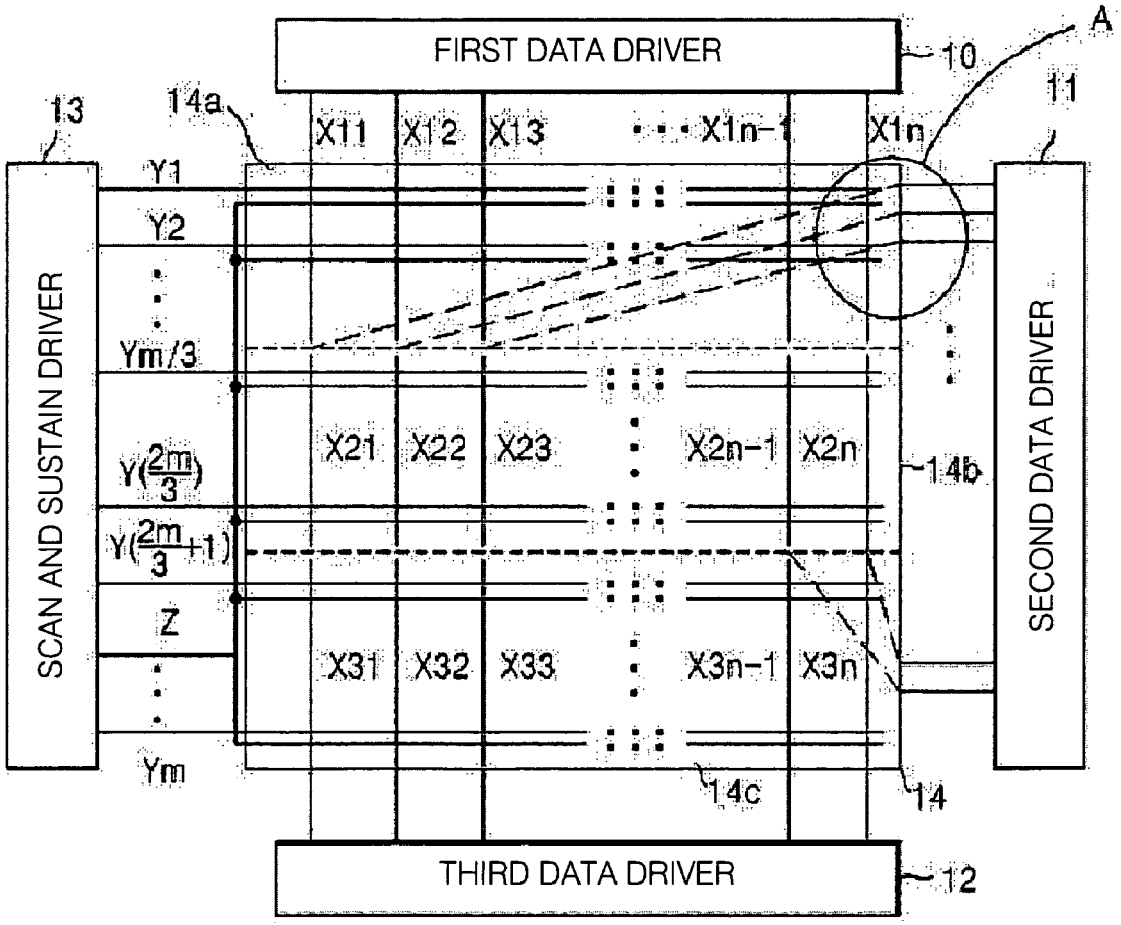
FIG. 3 is a view illustrating a plasma display panel according to the present invention.

FIG. 3 is a view illustrating a plasma display panel according to the present invention.

Referring to FIG. 3, address electrodes X11 to X3*n* on a plasma display panel 14 according to the present invention are classified into three or more groups. The electrode groups are driven by additional data drivers 10, 11 and 12.

More particularly, the address electrodes X11 to X1*n* disposed at an upper side of the plasma display panel are defined as a first electrode group 14*a*. The first electrode group 14*a* is supplied with a driving signal by the first data driver 10. Furthermore, the address electrodes X21 to X2*n* located at the central portion of the plasma display panel are defined as a second electrode group 14*b*. The second electrode group 14*b* is supplied with a driving signal by the second data driver 11. The address electrodes X31 to X3*n* disposed at a lower side of the plasma display panel are defined as a third electrode group 14*c*. The third electrode group 14*c* is supplied with a driving signal by the third data driver 12.

The plasma display panel according to the present invention furthermore includes a scan and sustain driver 13 for supplying a scan pulse and a sustain pulse.

As described above, the plasma display panel 14 of the present invention is divided into three regions. The address electrodes of each region are classified into the first to third electrode groups 14*a*, 14*b* and 14*c*. The address electrodes X are formed in a rear substrate. Scan electrodes Y and a sustain electrode Z are formed in a front substrate in such a way as to cross the address electrodes.

The address electrodes X11 to X1*n* belonging to the first electrode group 14*a* are disposed at the upper region of the plasma display panel 14 and select a discharge cell through a discharge with first to $(m/3)^{th}$ scan electrodes Y1 to Ym/3.

Furthermore, the address electrodes X21 to X2*n* belonging to the second electrode group 14*b* are disposed at the central region of the plasma display panel 14 and select a discharge cell through a discharge with $(m/3+1)^{th}$ to $(2m/3)^{th}$ scan electrodes Ym/3+1 to Y2*m*/3.

In a similar way, the address electrodes X31 to X3*n* belonging to the third electrode group 14*c* are disposed at the lower region of the plasma display panel 14 and select a discharge cell through a discharge with $(2m/3+1)^{th}$ to $m^{th}$ scan electrode Y2*m*/3+1 to Ym.

Furthermore, the first data driver 10 supplies a data pulse to the address electrodes X11 to X1*n* belonging to the first electrode group 14*a*. The second data driver 11 supplies a data pulse to the address electrodes X21 to X2*n* belonging to the second electrode group 14*b*. The third data driver 12 supplies a data pulse to the address electrodes X31 to X3*n* belonging to the third electrode group 14*c*.

The scan and sustain driver 13 supplies the scan pulse and the sustain pulse to a plurality of scan electrodes Y and the sustain electrodes Z. The scan and sustain driver 13 consists of a scan driver and a sustain driver that supply the driving pulse during a reset period, an address period and a sustain period.

In the plasma display panel constructed above according to the present invention, the first to third data drivers 10 to 12 supply the driving signals to the address electrodes that are classified into the three electrode groups. Therefore, the address period can be shortened to about ⅓ in comparison with the related art and a signal transfer distance can also be shortened. This results in an improvement in the related art problems incurred by voltage drop. Furthermore, since the scan pulses are supplied to the three discharge cell lines during the address period, high speed driving is made possible.

Figure 4:
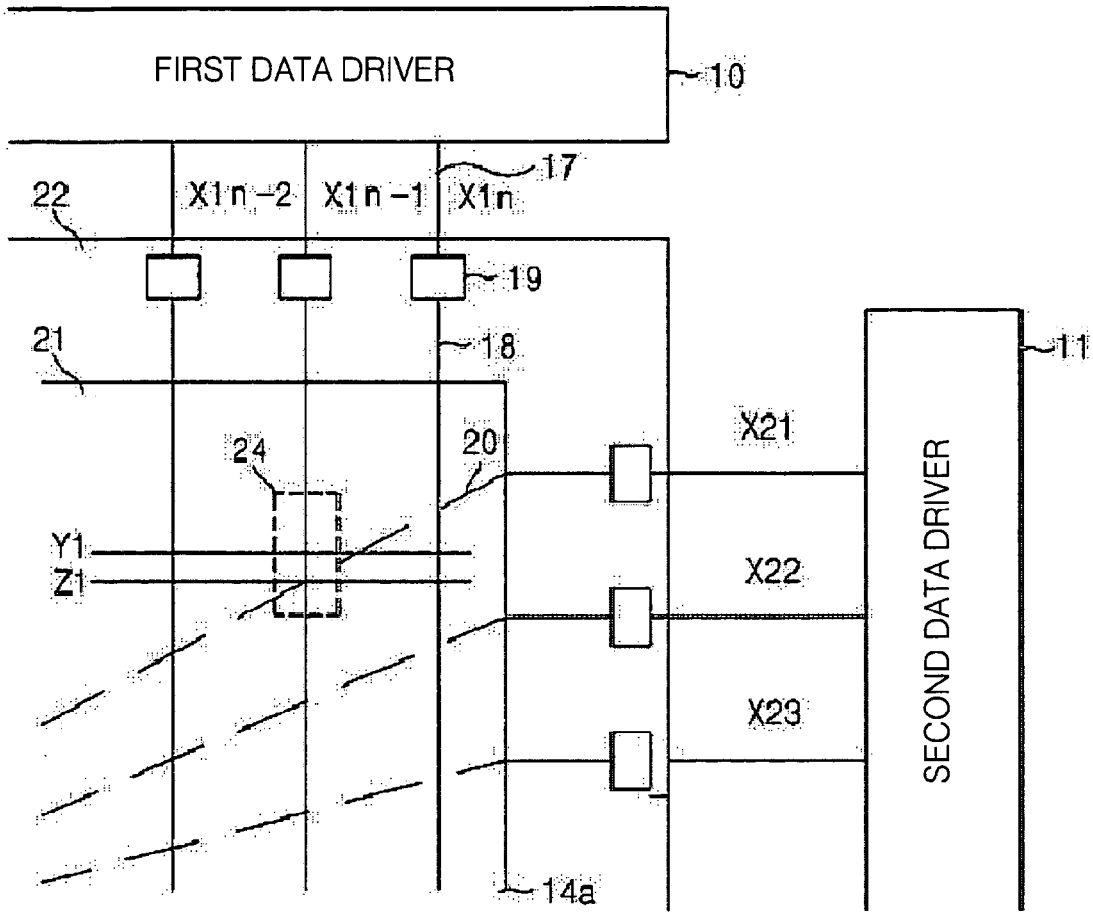
FIG. 4 is an exaggerated view of a portion "A" in FIG. 3.

FIG. 4 is an exaggerated view of a portion "A" in FIG. 3. A connection structure of each data driver and the address electrodes will be described below with reference to FIG. 4.

The plasma display panel 14 includes a display region 21 on which images are displayed by a discharge and a non-display region 22 on which images are displayed externally. The non-display region 22 is formed around the display region 21. The non-display region 22 includes pads 19 to which signal lines 17 of each driver are connected, and links 18 for connecting the pads 19 and the plurality of electrodes X, Y and Z.

More particularly, on the rear substrate below the first electrode group 14*a* and third electrode groups 14*c* are formed contact electrodes 20 for supplying driving signals to the address electrodes X21 to X2*n* that belong to the second electrode group 14*b*. The contact electrodes 20 are connected to the second data driver 11.

The structure of the contact electrodes 20 and the electrodes formed on the lower layer of the address electrodes that belong to the first and third electrode groups 14*a*, 14*c* will be described below with reference to FIG. 5.

Figure 5:
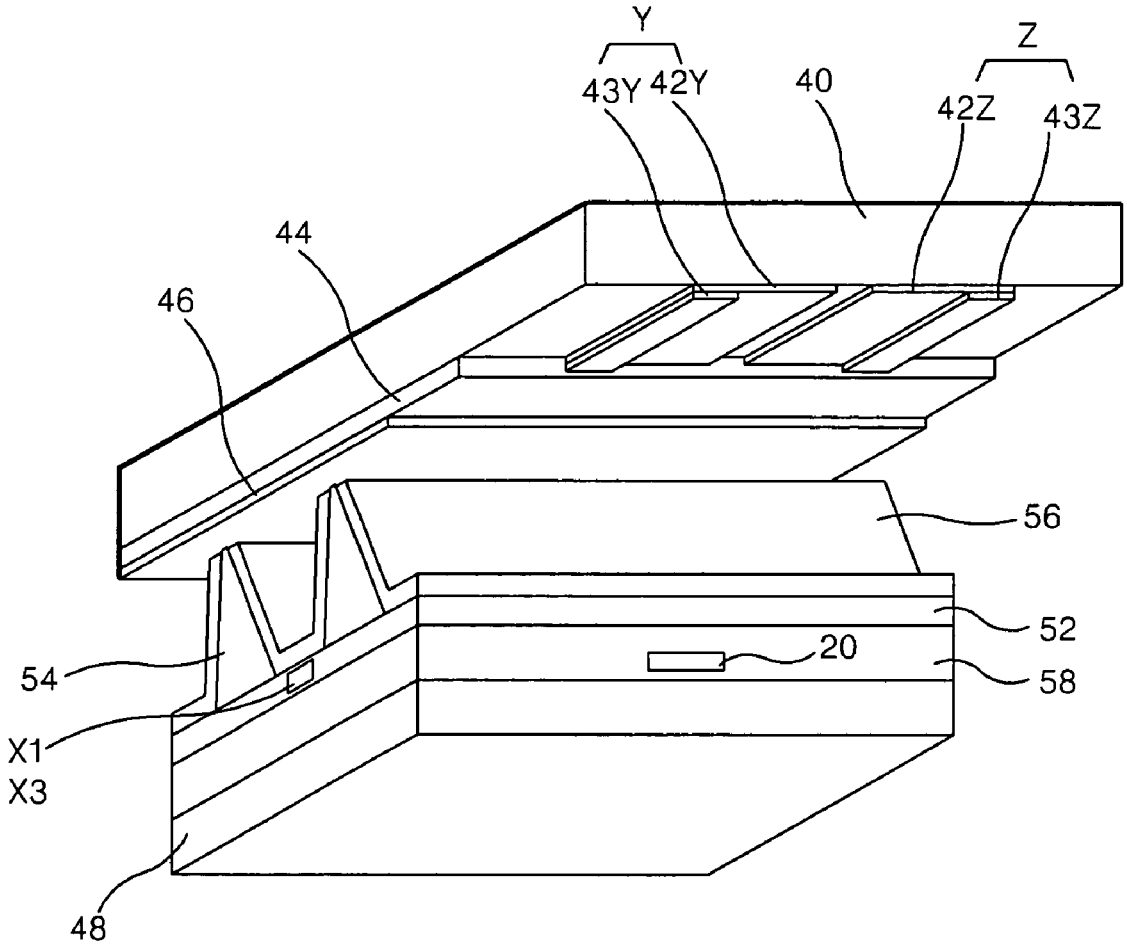
FIG. 5 is a perspective view of a discharge cell in which first and third electrode groups are formed.

FIG. 5 is a detailed view illustrating the structure of a discharge cell formed in the upper and lower regions of the plasma display panel.

Referring to FIG. 5, a scan electrode Y and a sustain electrode Z are formed on a front substrate 40. The address electrodes X1, X3 belonging to the first and third electrode groups 14*a*, 14*c*, and the contact electrode 20 are disposed in the rear substrate 48.

The scan electrode Y includes a transparent electrode 42Y and a metal bus electrode 43Y having a line width smaller than that of the transparent electrode 42Y. The sustain electrode Z includes a transparent electrode 42Z, and a metal bus electrode 43Z having a line width smaller than that of the transparent electrode 42Z.

The transparent electrodes 42Y, 42Z are formed of metals such as Indium Tin Oxide (ITO), Indium Zinc Oxide (IZO), Indium Tin Zinc Oxide (ITZO) or the like. The metal bus electrodes 43Y, 43Z are generally formed of metals such as chromium (Cr), and function to reduce voltage drop, which is incurred by the transparent electrodes 42Y, 42Z having high resistance.

Furthermore, on the front substrate 40 is laminated an upper dielectric layer 44 that covers the scan electrode Y and the sustain electrode Z. A protection film 46 that prevents damage to the upper dielectric layer 44 due to sputtering generated during the discharge of plasma is laminated on the upper dielectric layer 44. Magnesium oxide (MgO) is generally used as the protection film 46.

The contact electrode 20 is formed over the rear substrate 48. A dielectric layer 58 is formed on the rear substrate 48 including the contact electrode 20. That is, the dielectric layer 58 functions to provide insulation between a lower dielectric layer 52 and the address electrode X1, and the contact electrode 20. Furthermore, the contact electrode 20 is connected to the address electrode X2 belonging to the second electrode group 14*b*.

On the dielectric layer 58 are formed the address electrodes X1, X3, a lower dielectric layer 52 and barrier ribs 54. A phosphor layer 56 is coated on surfaces of the lower dielectric layer 52 and the barrier ribs 54. Furthermore, the address electrodes X1, X3 cross the scan electrode Y and the sustain electrode Z.

The barrier ribs 54 form a discharge space along with the front/rear substrates 40, 48. The barrier ribs 54 function to prevent ultraviolet rays, which are generated by gas discharge, and a visible ray from leaking to neighboring discharge cells.

The discharge space is filled with an inert gas for gas discharge, such as He, Ne, Ar, Xe or Kr, a discharge gas (or a mixed gas) in which the gas discharges are combined, or Excimer gas that can generate ultraviolet rays through a discharge.

The phosphor layer 56 is excited by ultraviolet rays generated during the discharge of plasma, and generates any one visible ray of red (R), green (G) and blue (B).

Figure 6:
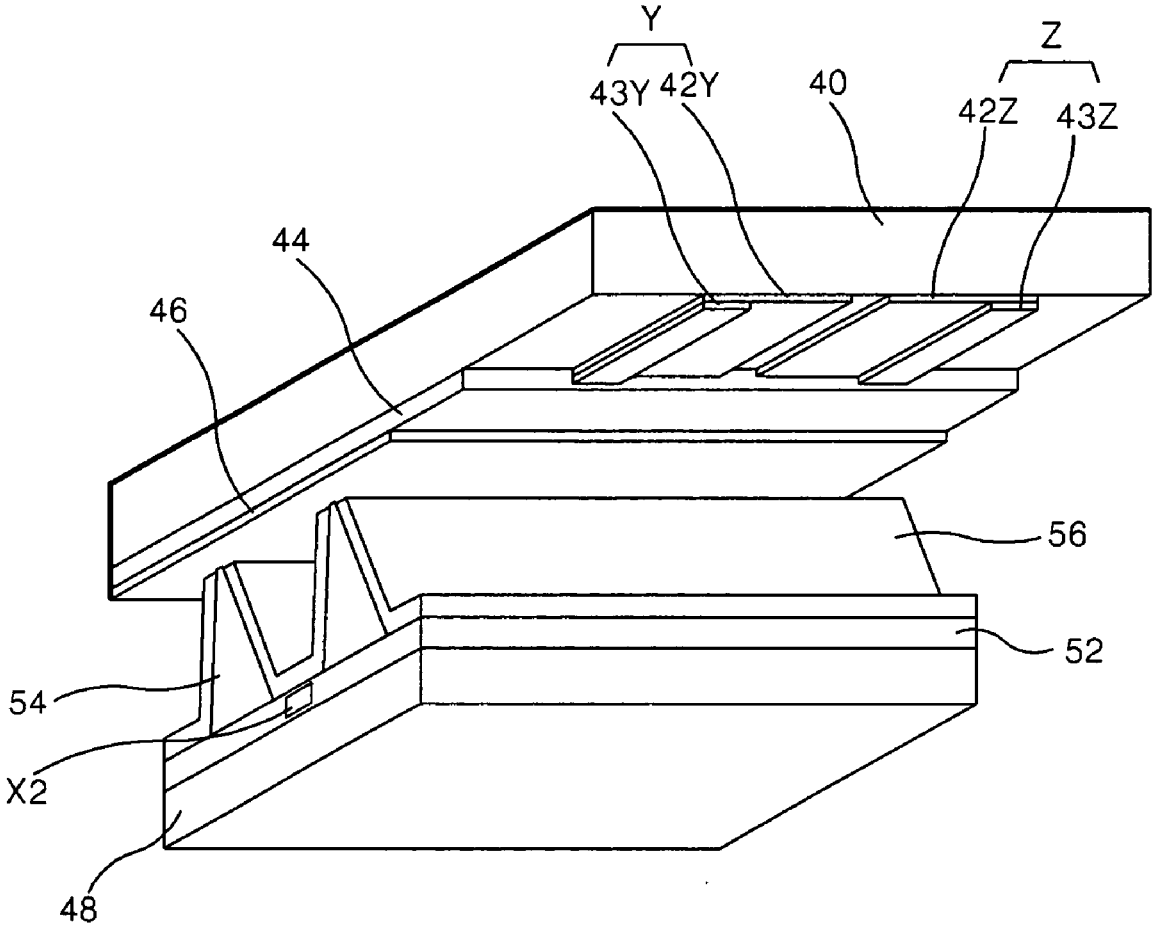
FIG. 6 is a perspective view of a discharge cell in which a second electrode group is formed.

FIG. 6 shows the structure of a discharge cell formed at the central region of the plasma display panel. The discharge cell 24 shown in FIG. 6 does not include the contact electrodes 20 and the dielectric layer 58 formed below the lower dielectric layer 52, as shown in FIG. 5.

The discharge cell 24 in which the address electrode X2 belonging to the second electrode group 14*b* is formed has the same construction as that of FIG. 5 except that it does not include the contact electrodes 20 and the dielectric layer 58. Therefore, description thereof will be omitted in order to avoid redundancy.

Figure 7A:
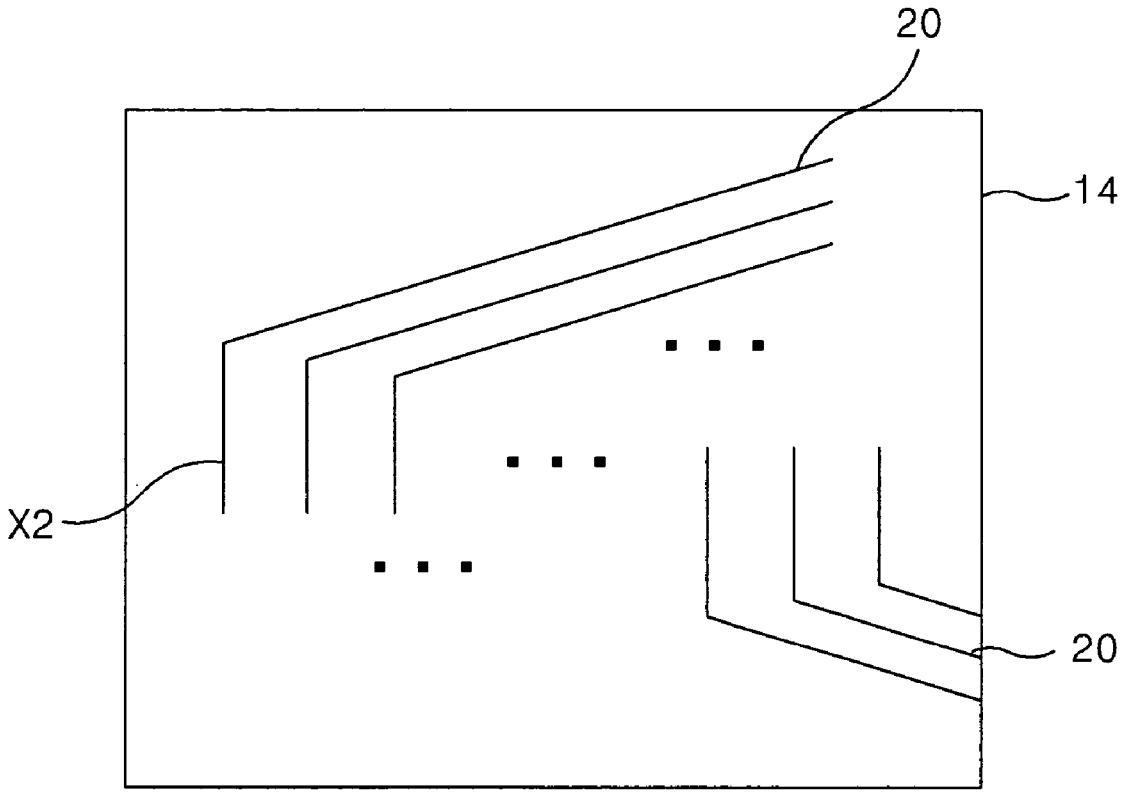
FIG. 7 is a simplified view illustrating a process of manufacturing the plasma display panel of FIG. 3.
Figure 7B:
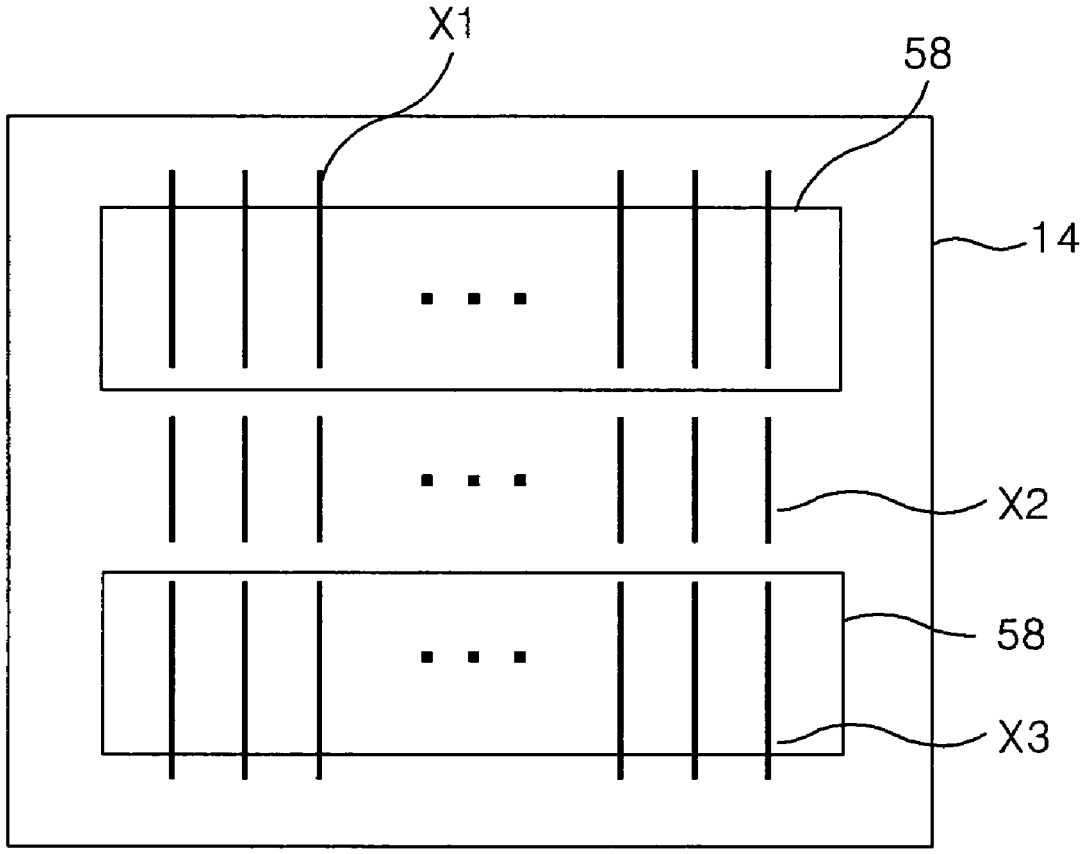
Figure 7C:
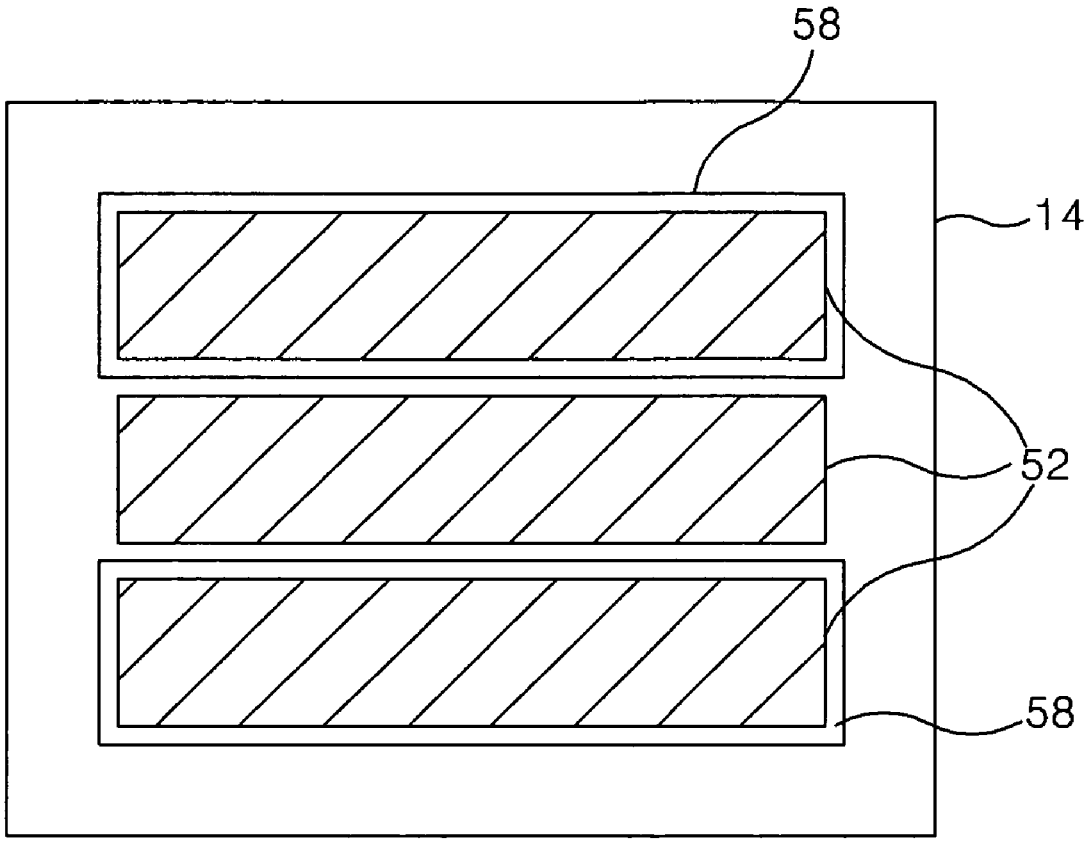

FIG. 7 is a simplified view illustrating a process of manufacturing the plasma display panel according to the present invention. The process can include processes shown in FIGS. 7*a* to 7*c*.

As shown in FIG. 7*a*, the contact electrodes 20 are formed in the upper and lower regions of the plasma display panel in which the first and third electrode groups 14*a*, 14*c* are formed. The address electrodes X2 belonging to the second electrode group 14*b* are formed in the central region of the plasma display panel.

If the contact electrodes 20 and the address electrodes X2 belonging to the second electrode group 14*b* are formed, the dielectric layers 58 that covers the contact electrodes 20 are formed in the upper and lower regions of the plasma display panel as shown in FIG. 7*b*. The address electrodes X1, X3 belonging to the first and third electrode groups 14*a*, 14*c* are formed on the dielectric layers 58. That is, the address electrodes X2 belonging to the second electrode group 14*b* and the address electrodes X1 belonging to the first and third electrode groups 14*a*, 14*c* are formed on different layers.

If the address electrodes X1, X3 belonging to the first and third electrode groups 14*a*, 14*c* are formed, the lower dielectric layers 52 that cover the entire address electrodes X1 to X3 are laminated as shown in FIG. 7*c*.

If the lower dielectric layers 52 are formed, the barrier ribs 54 and the phosphor layer 56 are sequentially formed on the lower dielectric layer 52.

Figure 8:
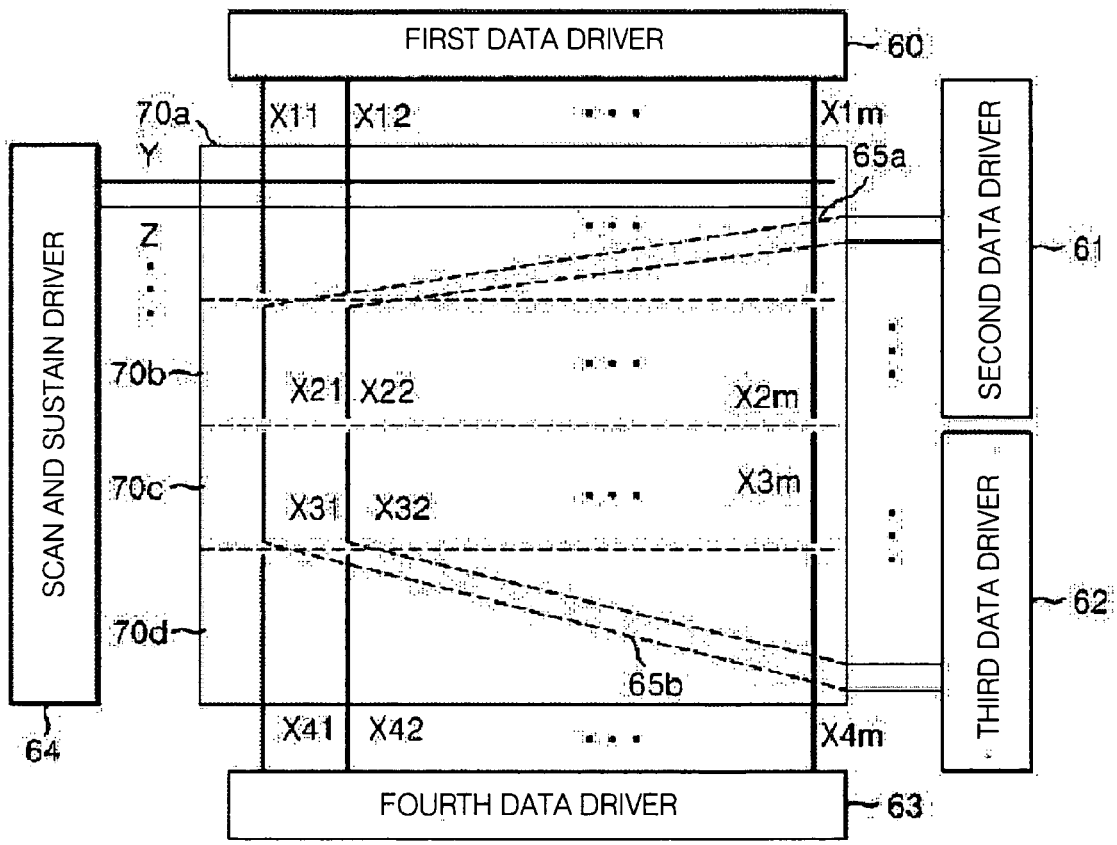
FIG. 8 is a simplified view illustrating another embodiment of a plasma display panel according to the present invention.

FIG. 8 is a simplified view illustrating another embodiment of a plasma display panel according to the present invention. FIG. 8 is different from FIG. 3 in that the plasma display panel is divided into four or more regions, and address electrodes formed in each region are classified into first to fourth electrode groups and are driven by first to fourth data drivers.

Referring to FIG. 8, the plasma display panel according to another embodiment of the present invention includes first to fourth data drivers 60 to 63, a scan and sustain driver 64, four regions 70*a* to 70*d* of a plasma display panel 70, address electrodes X11 to X4*m* classified into the four regions, a scan electrode Y, a sustain electrode Z, and contact electrodes 65*a*, 65*b*.

In FIG. 8, the plasma display panel 70 is divided into four or more regions 70*a*, 70*b*, 70*c* and 70*d*. The address electrodes X11 to X4*m* located in the respective regions 70*a*, 70*b*, 70*c* and 70*d* are classified into first to fourth electrode groups X11 to X1*m*, X21 to X2*m*, X31 to X3*m* and X41 to X4*m*.

The first to fourth data drivers 61 to 63 supply driving signals to the first to fourth electrode groups X11 to X1*m*, X21 to X2*m*, X31 to X3*m* and X41 to X4*m*, respectively.

In addition, the address electrodes X21 to X2*m*, X31 to X3*m* belonging to the second and third electrode groups X21 to X2*m*, X31 to X3*m* formed in a central region of the plasma display panel 70, and the first contact electrode 65*a* and the second contact electrode 65*b* that connect the second and third data drivers 61, 62 are formed on a lower rear substrate of the address electrodes X11 to X1*m*, X41 to X4*m* that belong to the first and fourth electrode groups X11 to X1*m* and X41 to X4*m*.

As described above, in the embodiment of FIG. 8, the first to fourth data drivers 60 to 63 supply the driving signals to the address electrodes that are classified into the fourth electrode groups.

Therefore, the address period can be shortened to about ¼ in comparison with the related art and a signal transfer distance can also be shortened. This results in an improvement in the related art problems incurred by voltage drop. Furthermore, since the scan pulses are supplied to the four discharge cell lines during the address period, high speed driving is made possible.

Furthermore, the embodiment of FIG. 8 is an example illustrating that various modifications are possible according to the technical spirit of the present invention. The construction and operation of each of the remaining elements are the same as those of FIGS. 3 to 7. Therefore, description thereof will be omitted in order to avoid redundancy. In addition, it is to be understood that the number of regions that divide the plasma display panel 70 and the number of electrode groups may be varied depending on the size of a plasma display panel.

Furthermore, according to the plasma display panel of the present invention, the data driver that applies the driving signal to the address electrodes through the contact electrodes applies the driving voltage taking voltage drop of the contact electrodes into consideration. It is thus possible to compensate for the problem of voltage drop due to the electrodes formed in the plasma display panel.

As described above, according to the present invention, a plasma display panel is divided on a region basis. Address electrodes located in each region are classified on a group basis. A data driver is disposed corresponding to each group.

Furthermore, in the plasma display panel according to the present invention, to apply the driving signal to the address electrodes formed in the central region of the plasma display panel, the contact electrodes that pass through the bottom of a neighboring region are additionally formed.

Accordingly, in the plasma display panel according to the present invention, a plurality of lines can be scanned at the same time by a number of drivers and the divided plasma display panel during the address period. Therefore, high speed driving is made possible. Furthermore, a discharge period allocated to each discharge cell can be extended in comparison with the related art in which the single or dual scan method is applied. It is thus possible to improve the display quality.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. A plasma display panel comprising:

one or more scan electrodes and sustain electrodes formed in a front substrate;

one or more address electrodes formed in a rear substrate opposite the front substrate, the address electrodes crossing the scan electrodes and the sustain electrodes; and barrier ribs formed between the front substrate and the rear substrate, for partitioning a discharge space;

first to third data drivers that apply driving signals to first to third electrode groups, respectively, wherein the address electrodes are driven by being divided into the first to third electrode groups, each of the electrode groups being defined by a separate region of the plasma display panel that runs parallel to a direction of the scan electrodes and the sustain electrodes, wherein the address electrodes are divided into three regions between an upper side and a lower side of a display region of the plasma display panel, and address electrodes belonging to each region are classified into the first to third electrode groups, wherein the address electrodes belonging to the second electrode group and the address electrodes belonging to the first and third electrode groups are formed on different layers, wherein the first electrode group is provided at an upper side of the plasma display panel, the third electrode group is provided at a lower side of the plasma display panel, and the second electrode group is provided between the first electrode group and the second electrode group, wherein signal lines of each of the first to third electrode groups are connected to each of the first to third data drivers through a corresponding pad unit, wherein the signal lines of the second electrode group are connected to the corresponding pad unit through contact electrodes, wherein the contact electrodes are formed on the rear substrate below the first and third electrode groups, and wherein on the rear substrate below the first electrode group and the third electrode group an insulation layer is provided that insulates the address electrodes belonging to the first electrode group and the third electrode group, and the contact electrodes.

2. The plasma display panel as claimed in claim 1, wherein the first to third data drivers apply the driving signals to the first to third electrode groups at a same time.

3. A plasma display panel, wherein scan electrodes and sustain electrodes are formed in a front substrate, and address electrodes cross the scan electrodes and the sustain electrodes and the address electrodes are classified into first to third electrode groups along lines that run parallel to a direction of the scan electrodes and the sustain electrodes, the second electrode group is formed on a rear substrate opposite the front substrate, and the first electrode group and the third electrode group are formed on an insulation layer formed in the rear substrate, wherein the first electrode group is provided at an upper side of the plasma display panel, the third electrode group is provided at a lower side of the plasma display panel, and the second electrode group is provided between the first electrode group and the third electrode group, wherein the address electrodes belonging to the second electrode group are formed on a different layer than the address electrodes belonging to the first and third electrode groups, and wherein contact electrodes are formed on the rear substrate in which the first electrode group and the third electrode group are formed, and the insulation layer insulates the contact electrodes and address electrodes belonging to the first electrode group and the third electrode group.

4. The plasma display panel as claimed in claim 3, wherein the contact electrodes are connected to signal lines of the second electrode group.

5. The plasma display panel as claimed in claim 4, wherein the first to third electrode groups are formed by sequentially dividing upper/lower sides or lower/upper sides of a display region of the plasma display panel into three regions and then grouping address electrodes.

6. A plasma display panel comprising:

scan electrodes and sustain electrodes formed in a front substrate;

address electrodes formed in a rear substrate opposite the front substrate, the address electrodes crossing the scan electrodes and the sustain electrodes; and barrier ribs formed on the rear substrate, for partitioning a discharge space, wherein the address electrodes are driven by being divided into first to fourth electrode groups along lines that run parallel to a direction of the scan electrodes and the sustain electrodes, wherein address electrodes belonging to the first to fourth electrode groups are formed within a display region of the plasma display panel, on which images are substantially displayed, and wherein the first to fourth electrode groups are formed by sequentially dividing from upper side to lower side or from lower side to upper side of the display region of the plasma display panel into four regions and then grouping address electrodes, wherein the address electrodes belonging to the second electrode group and the address electrodes belonging to the first electrode group and the fourth electrode group are formed on different layers, wherein contact electrodes, and an insulation layer that insulates the contact electrodes and the address electrodes belonging to the first electrode group and the fourth electrode group are formed on the rear substrate below the first electrode group and the fourth electrode group.

7. The plasma display panel as claimed in claim 6, wherein the first to fourth electrode groups are supplied with driving signals from first to fourth data drivers, respectively.

8. The plasma display panel as claimed in claim 6, wherein the contact electrodes are connected to signal lines of the second and third electrode groups.

* * * * *